US006948785B1

(12) United States Patent
Frank

(10) Patent No.: US 6,948,785 B1
(45) Date of Patent: Sep. 27, 2005

(54) TRACK SYSTEM FOR MOBILE CARRIAGES

(75) Inventor: Jeffrey W. Frank, Mayville, WI (US)

(73) Assignee: TAB Products Company, Mayville, WI (US)

( * ) Notice: Subject to any disclaimer, the term of this patent is extended or adjusted under 35 U.S.C. 154(b) by 0 days.

(21) Appl. No.: 10/235,360

(22) Filed: Sep. 5, 2002

Related U.S. Application Data

(60) Provisional application No. 60/317,714, filed on Sep. 6, 2001.

(51) Int. Cl.[7] ..... A47B 53/00
(52) U.S. Cl. ..... 312/201
(58) Field of Search ..... 312/198, 199, 312/200, 201; 52/126.1, 126.5; 104/106; 238/8; 211/162

(56) References Cited

U.S. PATENT DOCUMENTS 1,613,850 A * 1/1927 Scherm ..... 238/8
4,417,524 A * 11/1983 Quinn et al. ..... 105/101
4,467,924 A * 8/1984 Morcheles ..... 211/1.57
4,693,418 A 9/1987 Peterman
4,708,411 A * 11/1987 Peterman ..... 312/201
4,770,475 A * 9/1988 Peterman ..... 312/201
5,004,304 A 4/1991 Segerpalm et al.
5,435,639 A * 7/1995 Smits et al. ..... 312/201
RE35,047 E 10/1995 Potter
5,711,227 A * 1/1998 Johnson ..... 104/126
6,027,190 A * 2/2000 Stewart et al. ..... 312/201
6,231,138 B1 * 5/2001 Janson ..... 312/201
6,669,314 B1 * 12/2003 Nemec et al. ..... 312/201

* cited by examiner

*Primary Examiner*—Janet M. Wilkens
(74) *Attorney, Agent, or Firm*—Ryan Kromholz & Manion, S.C.

(57) ABSTRACT

A track system for high density mobile storage comprises parallel tracks each receiving a rail on which mobile carriages roll. The tracks are supported off a building floor by multiple transverse leveler channels. A pair of insert nuts are immovably held in each leveler channel. Elevator bolts rest on the building floor and engage the insert nuts. Turning the elevator bolts adjusts the height of the tracks above the building floor. Deck channels have holes in opposite ends that fit over the insert nuts of two leveler channels secured to the two tracks. The deck channels thus space the tracks parallel to each other. A deck panel is supported by and joined to both a wing of each track and the deck channels. Additional leveling devices are used to support the deck channels off the building floor.

34 Claims, 4 Drawing Sheets

1
2
2
3
5
6
7
8
9
10
12
14
16
27
49
63
69
70
71
73
75
77
80
81
83

TRACK SYSTEM FOR MOBILE CARRIAGES

This application claims priority on provisional application No. 60/317,714, filed Sep. 6, 2001.

BACKGROUND OF THE INVENTION

1. Field of the Invention

This invention pertains to supporting and guiding rolling structures, and more particularly to parallel and level rails installed on a building floor.

2. Description of the Prior Art

Various types of tracks have been developed in conjunction with high density mobile storage. The tracks support the wheels of mobile carriages for efficient rolling along a building floor. The tracks also guide the mobile carriage wheels for straight line motion.

Mobile carriage tracks invariably include multiple parallel rails that are in contact with the mobile carriage wheels. The rails are usually utilized with other components that both keep the rails level and that space them parallel to each other at the proper distance. It is further necessary that the tracks remain permanently in place on the building floor after original installation. Some tracks are also used to support a deck that provides a walking surface for personnel using the high density mobile storage.

In the past, installing tracks for high density mobile storage was a major task. Permanence of an installation was often obtained by grouting the tracks to the building floor. Grout was also used in some instances for the rail leveling procedure. Working with grout was messy, and it took some experience before a person learned to handle and use the grout efficiently.

Examples of different types of prior tracks for high density mobile storage may be seen in U.S. Pat. Nos. 3,640,595; 4,597,615; 4,770,475; 4,802,622; 5,007,351; 5,069,513; 5,205,627; 5,341,944; 5,439,281; and 5,943,967. Most of the foregoing patents teach little or nothing regarding uniformly spacing the rails apart from each other for long rail lengths.

U.S. Pat. No. 4,693,418 shows a modular floor for high density mobile storage. The rails are spaced apart by wood deck panels, to which the rails are directly secured.

U.S. Pat. No. 5,004,304 shows rails interconnected by transverse spacer members. In U.S. Pat. No. 5,967,346, the rails are integral parts of a large plate that is suitably bent to accommodate the wheels of rolling carriages.

U.S. patent Re. 35,047 shows rails for wheeled storage racks. The rails fasten to a base. Leveler foot screws act on the rails to level both the base and the rails.

Accurate parallelism of rails is sometimes achieved by separate and reusable spacer bars. The spacer bars are not part of the tracks themselves, but are carried from job to job by installing servicemen.

In spite of the numerous track designs presently available for high density mobile storage, there is a need for further improvements to them.

SUMMARY OF THE INVENTION

In accordance with the present invention, a track system for mobile carriages is provided that is simpler and more economical to install than prior track systems. This is accomplished by apparatus that includes deck channels that both space the rails on which the mobile carriages roll and support a deck on which operating personnel walk.

According to one aspect of the invention, each rail is received in a top surface of an associated elongated track that extends for the full length of the rail. In turn, each track is supported off a building floor by a number of longitudinally spaced transversely oriented leveler channels. The leveler channels are relatively short. They are secured to bottom surfaces of the associated tracks.

To adjust the height of the tracks and rails above the building floor, the track system further comprises a pair of leveling devices in association with each leveler channel. Each leveling device comprises an elevator bolt that rests on the floor and that mates with an insert nut pressed in the leveler channel. By turning the elevator bolts, the distance of the leveler channels above the floor can be adjusted. The elevator bolts are designed to maintain a minimum distance of the leveler channel from the floor.

The track system of the invention is designed such that the insert nuts in the leveler channels are at accurately spaced distances from the rails in the associated tracks. To space the rails, the deck channels are employed. Each deck channel has a pair of accurately spaced holes, one near each end. The holes in the deck channel are sized to snugly fit over the insert nuts. By placing the holes in the deck channels over the insert nuts of the leveler channels of two tracks, the leveler channels, and thus the tracks and rails, are brought into equal distances apart for the full lengths of the tracks and rails. The rails are thus accurately spaced apart parallel to each other in a very rapid fashion.

Further in accordance with the present invention, the deck channels support panels of decking between the tracks and rails. The deck panels are joined to the deck channels by deck fasteners. The deck fasteners fasten the deck panels and deck channels in a single operation. Due to the design of the elevator bolts, there is always a minimum distance from the leveling channels to the floor. To provide further stability to the deck panels, the tracks are designed with oppositely extending generally horizontal wings. The edges of the deck panels adjacent the tracks are supported on and are joined to the track wings.

The entire track system is installable with minimum time and effort. After the deck channels are in place, the elevator bolts are adjusted to level the rails. A few of the leveler channels associated with each track are anchored to the building floor. Finally, the deck panels are overlaid on the deck channels and joined to them and to the track wings. No special spacer bars or grout are required for the track system installation, yet it remains in place indefinitely. If necessary, the rails can be releveled at a future time by the leveling devices without disturbing the parallelism of the rails. The method and apparatus of the invention using accurately manufactured deck channels and leveler channels, thus enables exceptionally rapid and easy installation of a track system for mobile carriages. The deck channels perform double duty of both supporting the deck panels, as well as cooperating with the insert nuts and leveler channels to accurately space the rails apart.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
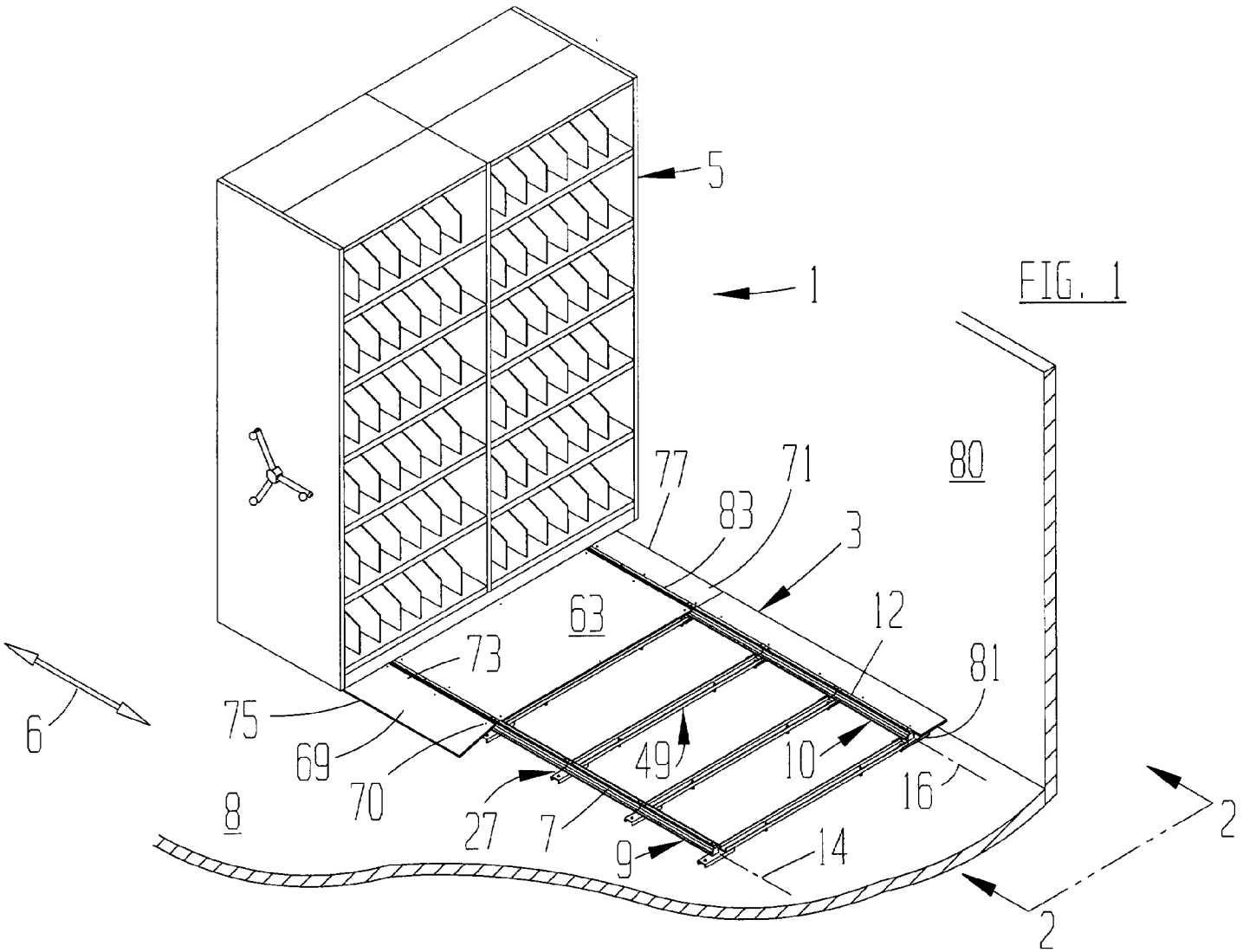
FIG. 1 is a perspective view of a typical mobile carriage in conjunction with the track system of the present invention.

Referring to FIG. 1, a typical installation of high density mobile storage 1 is illustrated that includes the track system 3 according to the present invention. The high density mobile storage 1 includes one or more mobile carriages typically shown at reference numeral 5. Wheels, not shown, under the mobile carriage 5 roll it horizontally in the directions of arrows 6 over a building floor 8 along the track system 3. For purposes of explaining the present invention, the directions of the arrows 6 will be considered the longitudinal direction of the track system, and the horizontal directions perpendicular to the arrows 6 will be considered the transverse direction of the track system.

In the illustrated construction, the track system 3 is comprised of a number of longitudinally extending tracks 9 and 10. Looking also at FIGS. 2 and 3, each track 9 and 10 has a generally I-beam or cruciform shape with a bottom surface 11, a top surface 13, and a central region 24. The generally I-beam or cruciform shape minimizes material costs while maximizing strength of the tracks 9 and 10. Each track further has a pair of wings 21 and 23 extending oppositely from the central region 24. Each wing 21 and 23 is undercut at its junction with the central region with an arcuate relief 25.

In each track top surface 13 is a slot 15. The slot 15 of the track 9 snugly receives a hardened rail 7. The slot in the track 10 snugly receives a similar rail 12. The rails 7 and 12 define respective longitudinal axes 14 and 16 and respective vertical planes through the longitudinal axes. For example, a vertical plane 18 passes through the longitudinal axis 16. The top surfaces 17 of the rails 7 and 12 are above the track top surfaces. The mobile carriage wheels roll on the rail top surfaces 17. To keep the rails in place in the track slots, a number of fasteners, such as roll pins 19, are used.

The tracks 9 and 10 are supported off the building floor 8 by a number of leveler channels 27, which are preferably made of steel. The leveler channels 27 are transverse to the tracks. Each leveler channel has a top wall 29 and side walls 31. The leveler channel top wall 29 is secured to the track bottom surface 11 by one or more fasteners 28.

In the top wall 29 of each leveler channel 27 is a pair of holes 35. The holes 35 are equally and accurately spaced on opposite sides of the vertical plane through the rail received in the associated track. For example, the holes 35 are equidistant from the vertical plane 18 through the rail 12.

The height of the tracks 9 and 10, and thus of the rails 7 and 12, above the building floor 8 is adjustable by means of a pair of leveling devices 37 in operative association with each leveler channel 27. Each leveling device 37 comprises an elevator bolt 38 and an insert nut 41. Each insert nut 41 has a shoulder 40 and a knurled outer diameter 42. The insert nut outer diameter 42 is forced into a hole 35 in the leveler channel top wall 29 until the shoulder 40 abuts the leveler channel top wall. In that situation, the insert nut outer diameter protrudes past the leveler channel top wall opposite the shoulder.

The elevator bolt is comprised of a base 39 and a shank 43. The shank 43 has an unthreaded length 44 adjacent the base 39. The unthreaded length 44 is preferably approximately 0.63 inches long. The shank 43 also has a threaded length 46 that is preferably approximately 1.1 inches long. The threaded length 46 of the elevator bolt 38 engages associated insert nuts 41, with the elevator bolt base 39 resting on the building floor 8. By turning the elevator bolts, the height of the leveler channels 27, and thus of the tracks 9, 10 and rails 7, 12, above the floor is adjustable. Turning the elevator bolts can be achieved by a screwdriver or similar tool placed in a slot 45 in the end of each elevator bolt shank 43.

It is an important feature of the invention that the rails 7 and 12 of the track system 3 are quickly and easily spaced equidistantly from each other in the transverse direction. For that purpose, the track system further comprises a number of deck channels 49. Each deck channel 49 is made of a middle leg 51 and side legs 53. In the middle leg 51, near the ends of the deck channel, are a pair of accurately spaced holes 55. The diameter of the holes 55 is such as to fit closely over the outer diameter 42 of a leveling device insert nut 41.

Figure 4:
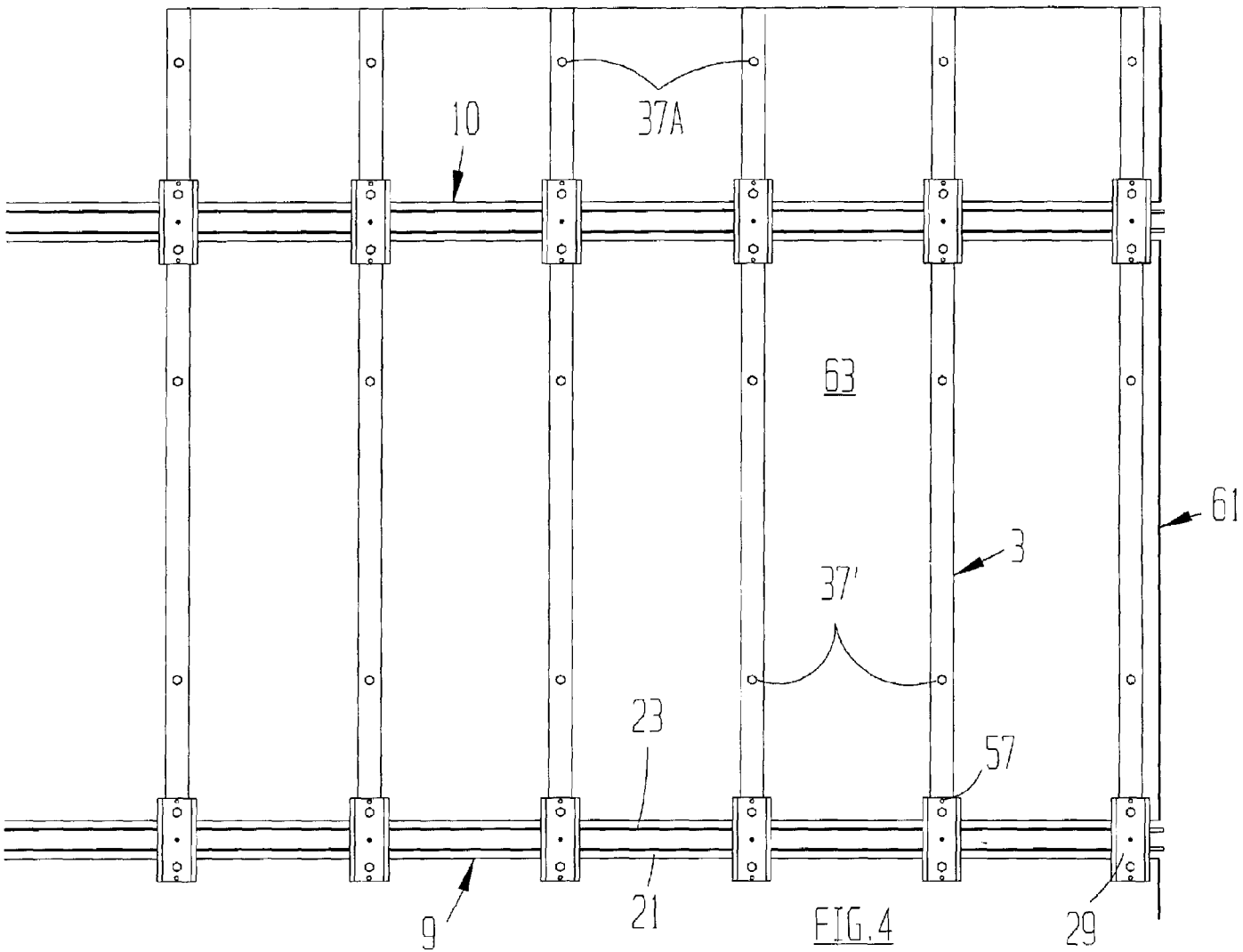
FIG. 4 is a bottom view of a portion of the track system.

The track system 3 is used by securing the leveler channels 27 to the tracks 9 and 10 by the fasteners 28. The insert nuts 41 are pressed into the leveler channel holes 35, and the elevator bolts 38 are threaded into the insert nuts. The elevator bolt bases 39 are placed on the floor 8, with the rails longitudinal axes 14 and 16 being generally parallel to each other and approximately at the correct transverse spacing. The deck channels 49 are oriented in the transverse direction between the leveler channels. The hole 55 at one end of the deck channel middle leg 51 is placed over the outer diameter 42 of an insert nut 41 of one of the leveling devices 37 fastened to a track 9 or 10. The other track is moved transversely slightly, if necessary, such that the second hole in the deck channel middle leg fits over the leveling device insert nut of the appropriate leveler channel of that track. The deck channel middle leg rests on the top walls 29 of the leveler channels. The procedure is repeated for all the leveler channels of both tracks. The result is that the rail longitudinal axes 14 and 16 become accurately parallel at the transverse spacing determined by the distance between the holes 55 in the deck channels. When the deck channels are in place on the leveler channel top walls, the free edges 60 of the deck channel side legs 53 are generally coplanar with the coplanar top surfaces 62 of the track wings 21 and 23. Leveling devices 37', FIG. 4, are used in conjunction with the middle legs of the deck channels to assure that the deck channel free edges 60 are in a level condition relative to the floor.

In most high density mobile storage 1, two or more tracks are laid end to end. To longitudinally align the tracks, pins shown at phantom lines 59 are pressed into the reliefs 25 in the tracks. The pins 59 protrude into the reliefs of an abutting track.

After the tracks 9 and 10 have been spaced transversely, the rails 7 and 12 are assembled to the tracks by means of the roll pins 19. The rails normally overlap the joints between adjacent tracks. The elevator bolts 38 are adjusted such that the top surfaces 17 of the rails lie in a single horizontal plane. The floor 8 is invariably uneven such that the elevator bolts 38 are threaded unequal amounts into the nuts 41. The unthreaded lengths 44 prevent the leveler channels 27 from approaching closer than a minimum distance to the floor 8. After the rails have been leveled and spaced, two or three leveler channels 27 associated with each track 9 and 10 are anchored to the building floor 8 by conventional anchor bolts, not illustrated in the drawings. To assist in the anchoring process, each leveler channel is provided with one or more holes 57 in the top wall 29. The track system 3 is thus rapidly and permanently installed in a level condition with the rails accurately parallel to each other.

Figure 2:
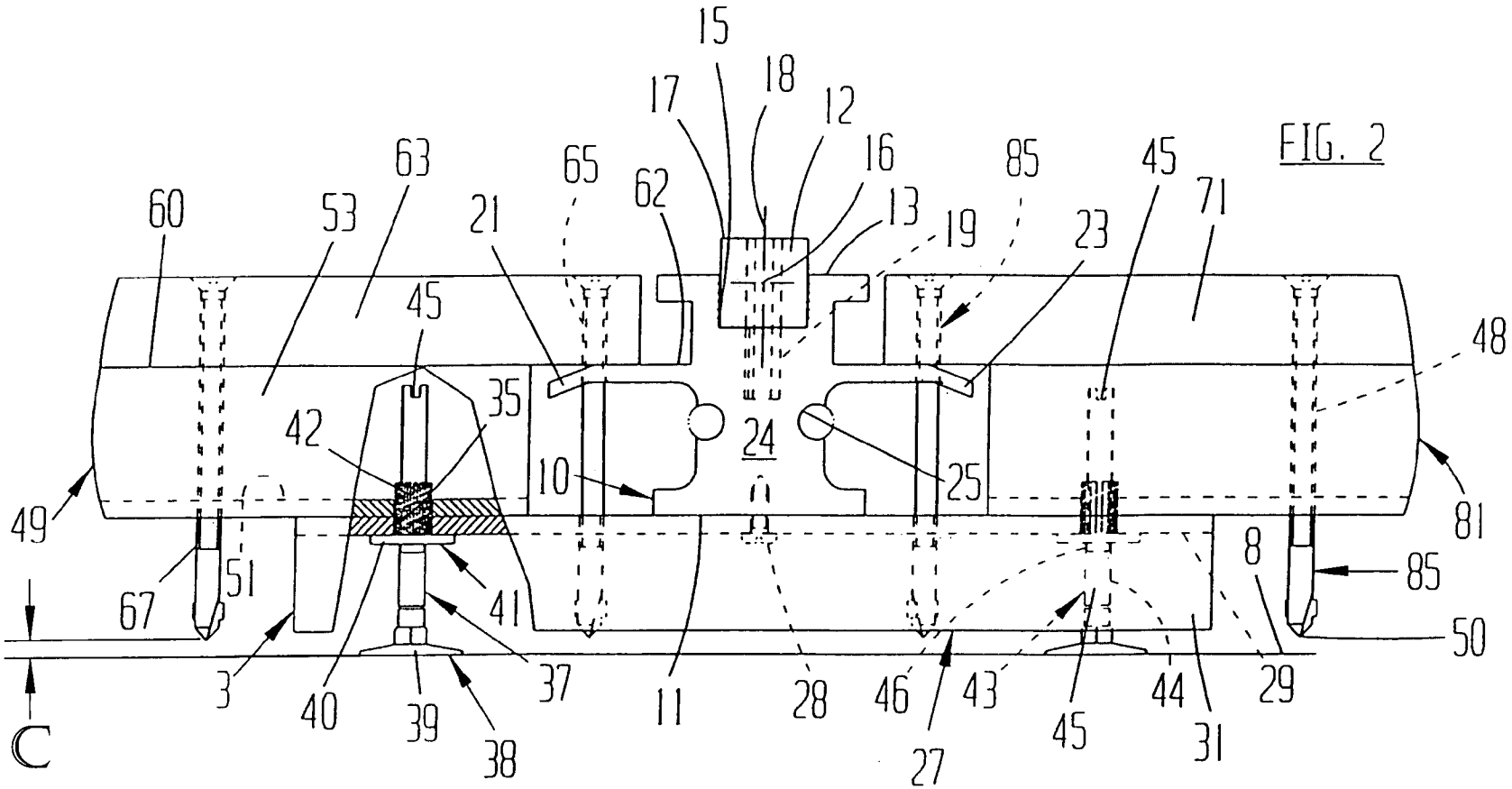
FIG. 2 is a partially broken view taken along line 2—2 of FIG. 1.
Figure 3:
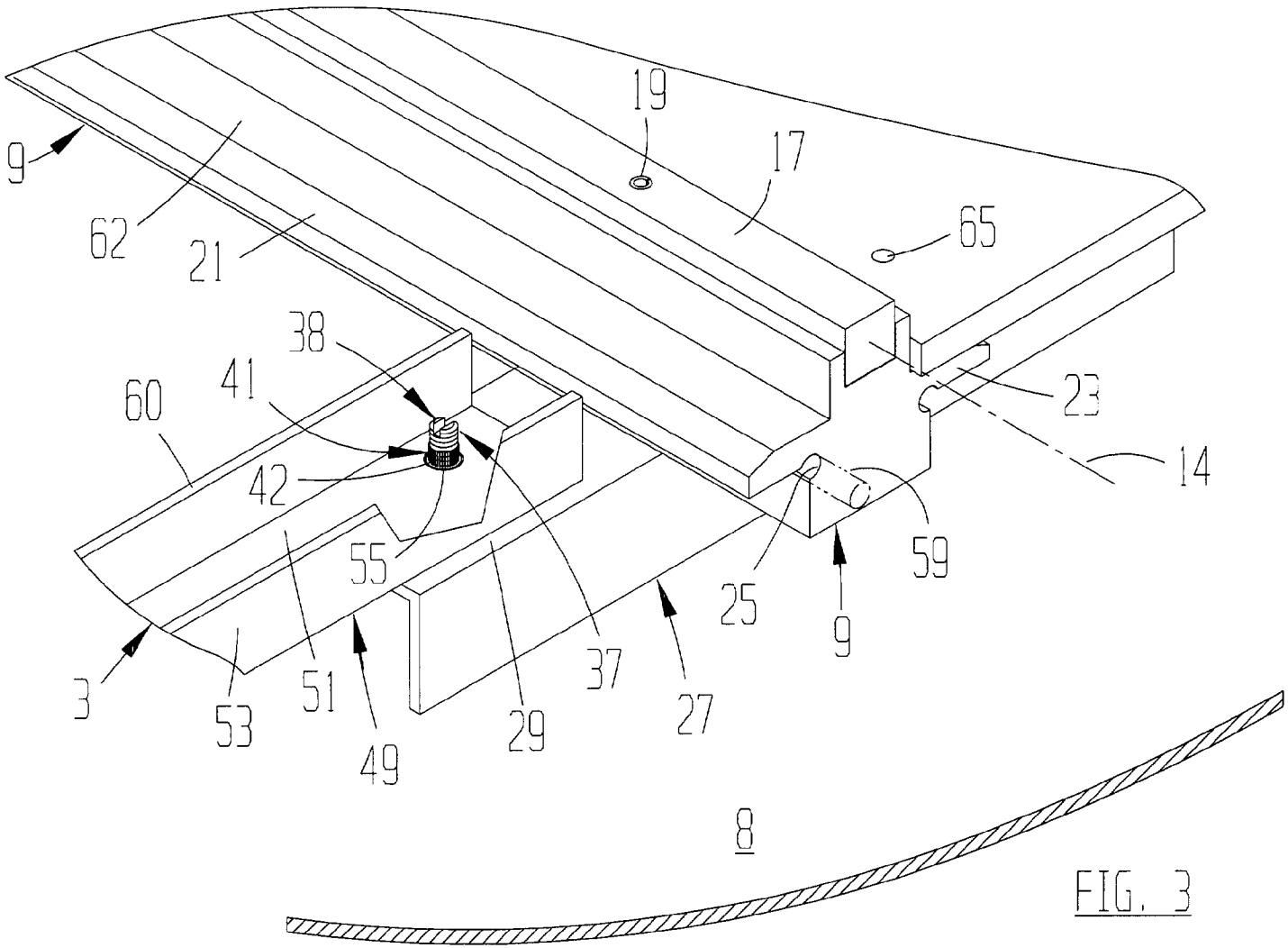
FIG. 3 is a perspective view of typical components of the track system.

Further in accordance with the present invention, the track system 3 includes an attractive and sturdy deck 61. The deck 61 is designed to serve as a floor for the high density mobile storage 1. The deck is comprised of center panels 63 between the two tracks 9 and 10. Each center panel 63 is supported on the wings 21 and 23 of the tracks. Fasteners 65 hold the center panels to the track wings. The fasteners 65 are preferably flat head TEK screws manufactured by ITW Buildex or Hilti. The fasteners have radial cutting edges that are capable of drilling a clearance hole in the deck center panel 63, and can self tap threads on in the leveler channel top wall 29 in a single operation with drilling the center panel clearance hole. The fastener cutting edges shear off when they contact the leveler channel. Because of the drilling features, the threads 48 of the fastener start at a considerable distance from the tip 50. The unthreaded length 44 of the elevator bolt 38 assures that there is always a minimum clearance C between the floor 8 and the fastener tip 50. The threaded length 46 is approximately equal to the system's leveling capacity. The preferred system leveling capacity is approximately 1 inch. As shown in FIG. 2, when the elevator bolt 38 is all the way turned in, the outer end of the elevator bolt 38 does not obstruct placement of the deck 61. The center panels are also supported on the free edges 60 of the deck channels 49. Fasteners 67 are used to join the center panels to the deck channel middle legs 51.

The deck 61 also has side panels 69 and 71 on the outsides of the tracks 9 and 10, respectively. The side panel 69 provides a ramped transition between the building floor 8 and the center panel 63. Accordingly, there are no deck channels on the outside of the track 9. One edge 73 of the side panel 69 is supported on the wing 21 of the track 9, to which it is joined by fasteners 70. The other edge 75 of the side panel 69 is supported on the building floor.

In FIG. 1, the side panel 71 is shown with a back edge 77 that is against a building wall 80. In that situation, it is preferred that the side panel 71 be a coplanar extension of the center panel 63. Accordingly, short deck channels 81 are placed under the side panel 71. Each short deck channel 81 rests on an associated leveler channel top wall 29 and is maintained at a level condition by a leveling device 37A. The front edge 83 of the side panel 81 is supported on and joined to the wing 23 of the track 10. Fasteners 85 join the side panel 71 to the short deck channels 81. Alternatively, if the building wall 80 is remote from the rear track 10 so that a walk way is created, the side panel 69 is used in place of side panel 71. Further, if the shelving requires longer carriages 5 than can be supported by tracks 9 and 10, then additional tracks, deck channels, and decks can be installed in modular fashion.

In summary, the results and advantages of high density mobile storage 1 can now be more fully realized. The track system 3 provides both rapid and economical installation of the high density mobile storage as well as permanence of the installation. This desirable result comes from using the combined functions of the insert nuts 41 and the deck channels 49. The leveler channels 27 support the tracks 9 and 10 off the building floor 8. The leveling devices 37 provide adjustment to the height of the leveler channels, and thus of the tracks and rails 7 and 12, above the floor. The deck channel holes 55 cooperate with the insert nuts 41 to accurately transversely space the tracks. Merely by placing the deck channel holes over the leveling device insert nuts associated with two different tracks, the transverse spacing is automatically set. The deck channels further function as supports for the deck center panels 63. Short side deck channels 81 support a side panel 71 between a track and a building wall 80. The entire track system is installed without special tools or special spacer bars, and without the use of any grout.

It will also be recognized that in addition to the superior performance of the track system 3, its total installed cost is less than that of conventional track systems. The ease and speed of assembling the track system of the invention more than compensates for any possible increased manufacturing cost of the various components of the track system.

Thus, it is apparent that there has been provided, in accordance with the invention, a track system for mobile carriages that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A track system on a building floor comprising:

a. first and second longitudinally extending tracks transversely spaced from each other;

b. a plurality of leveler channels secured transversely to each track;

c. adjustment means for adjusting the heights of the first and second tracks above the building floor;

d. a rail received in each track adapted to rollingly supports wheels of a selected structure;

e. spacer means for cooperating with the adjustment means to accurately space the tracks parallel to each other; and wherein each track has top and bottom surfaces and a central region therebetween, and with first and second wings that extend oppositely from the central region.

2. The track system of claim 1 wherein:

a. each first and second track is formed with a recess at a junction of each wing with the central region; and b. the track system further comprises pin means received in the recesses of each first and second track and that is also received in corresponding recesses in third and fourth tracks, respectively, to thereby longitudinally align and join the first track to the third track, and the second track to the fourth track.

3. The track system of claim 1 wherein each of said plurality of leveler channels comprises a respective leveler channel top wall and opposed side walls, each of the leveler channel top walls being secured to a respective track bottom surface.

4. The track system of claim 1 wherein the adjustment means comprises a pair of leveling devices in operative association with each leveler channel, each leveling device comprising an insert nut in the leveler channel, and an elevator bolt having a head that rests on the building floor and a shank that engages the insert nut, so that turning the elevator bolt adjusts the height of the leveler channel above the building floor.

5. The track system of claim 4 wherein:

a. the spacer means comprises a plurality of deck channels each having accurately spaced first and second holes proximate first and second ends, respectively;

b. the first hole of each deck channel fits over the insert nut of a first leveler channel secured to the first track; and c. the second hole of each deck channel fits over the insert nut of a second leveler channel secured to the second track, so that the first and second tracks are accurately transversely spaced parallel to each other by the deck channels.

6. The track system of claim 1 wherein:

a. each leveler channel is secured to a bottom surface of the associated track; and b. the adjustment means comprises:

i. an insert nut in the leveler channel; and ii. an elevator bolt in contact with the building floor and having an unthreaded portion and a threaded portion, wherein the threaded portion of the elevator bolt engages the insert nut to thereby enable adjustment of the distance of the leveler channel and thus of the associated track from the floor in response to turning the elevator bolt.

7. The track system of claim 6 wherein:

a. the elevator bolt comprises a head in contact with the building floor;

b. the elevator bolt unthreaded portion is adjacent the head; and c. the elevator bolt unthreaded portion cooperates with insert nut to prevent the leveler channel from approaching less than a predetermined minimum distance to the building floor.

8. The track system of claim 1 wherein:

a. the adjustment means comprises first and second insert nuts in operative association with each leveler channel; and b. the spacer means comprises a plurality of deck channels each having a first hole that fits with the first insert nut of a selected leveler channel associated with the first track, and a second hole at an accurate predetermined distance from the first hole that fits with the second insert nut of a selected leveler channel associated with the second track to thereby accurately space the first and second tracks transversely to each other.

9. The track system of claim 1 further comprising deck means for being walked on by personnel who work with the selected structure.

10. The track system of claim 9 wherein the deck means comprises:

a. a center deck panel between and supported by the first and second tracks and further supported by the spacer means; and b. means for joining the center deck panel to the first and second tracks and to the spacer means.

11. The track system of claim 1 further comprising a center deck panel between the first and second tracks and supported by and joined to the first wing of the first track and to the second wing of the second track.

12. The track system of claim 11 wherein the center deck panel is further supported by and is joined to the spacer means.

13. High density mobile storage comprising:

a. at least one mobile carriage; and b. a track system that supports and guides the mobile carriage rolling in longitudinal directions along a building floor, the track system comprising:

i. at least two tracks extending in a longitudinal direction;

ii. a rail received in a top surface of each track on which the mobile carriage rolls;

iii. leveling means for supporting the tracks off the building floor, wherein the leveling means comprises a plurality of leveler channels each secured to a bottom surface of a respective track and transverse thereto;

iv. adjustment means for adjusting the height of the tracks above the building floor; and v. spacer means for accurately spacing the rails parallel to each other.

14. The high density mobile storage of claim 13 wherein the adjustment means comprises multiple first leveling devices in operative association with each leveler channel, each first leveling device comprising an insert nut immovably held in the leveler channel, and an elevator bolt threaded in the insert nut and resting on the building floor, so that turning the elevator bolts adjusts the height of the leveler channels and the tracks and rails above the building floor.

15. The high density mobile storage of claim 14 wherein:

a. each leveler channel comprises a channel having a top wall that supports the associated track, and a pair of side walls; and b. the insert nuts are immovably held in the leveler channel top wall.

16. The high density mobile storage of claim 14 wherein the spacer means comprises a plurality of deck channels each having accurately spaced first and second holes, the first hole of each deck channel being fit over a selected one of the insert nuts in a selected leveler channel associated with a first track and the second hole of each deck channel being fit over a selected one of the insert nuts in a selected leveler channel associated with a second track to thereby accurately space the first and second tracks parallel to each other.

17. The high density mobile storage of claim 16 wherein:

a. each deck channel comprises a channel having a middle leg that defines the first and second holes, and a pair of side legs each having a free edge; and b. the high density mobile storage further comprises at least one deck panel between said at least two tracks that is supported by said at least two tracks and by the free edges of the deck channel side legs.

18. The high density mobile storage of claim 16 wherein:

a. each track has a central region under the rail and a pair of wings oppositely extending from the central region;

b. each deck channel comprises a channel having a middle leg that rests on an associated leveler channel and a pair of side legs having respective free edges; and c. the high density mobile storage further comprises at least one deck panel that is supported by the wings of the tracks and by the free edges of the deck channels.

19. The high density mobile storage of claim 18 wherein said at least one deck panel is joined to the wings of the tracks and to the middle legs of the deck channels.

20. The high density mobile storage of claim 18 further comprising at least one second leveling device in operative association with each deck channel, said at least one second leveling device comprising an insert nut immovably held in the middle leg of the deck channel, and an elevator bolt resting on the building floor and engaging the insert nut, so that turning the elevator bolt adjusts the height of the deck channel above the building floor.

21. The high density mobile storage of claim 13 further comprising at least one deck panel supported by and joined to said at least two tracks and supported by and joined to the spacer means.

22. The high density mobile storage of claim 21 wherein:

a. each of said at least two tracks has oppositely extending generally horizontal wings; and b. the deck panel is supported by and is joined to one of the wings of each of said at least two tracks.

23. A method of supporting a mobile carriage for rolling longitudinally along a building floor comprising the steps of:

a. providing first and second generally parallel longitudinally extending tracks;

b. securing a plurality of leveler channels transversely under each track;

c. adjustably supporting the leveler channels on the building floor;

d. spacing the first and second tracks parallel to each other; and e. receiving a rail in each track for rollingly supporting the mobile carriage.

24. The method of claim 23 wherein the step of adjustably supporting the leveler channels comprises the steps of:

a. holding a plurality of insert nuts in each leveler channel; and b. threading an elevator bolt into each insert nut and resting each elevator bolt on the building floor.

25. The method of claim 24 wherein the step of spacing the first and second tracks comprises the steps of:

a. providing a plurality of deck channels each having accurately spaced first and second holes therein;

b. placing the first hole of each deck channel over one of the insert nuts held in a selected leveler channel secured to the first track; and c. placing the second hole of each deck channel over one of the insert nuts held in a selected leveler channel secured to the second track and thereby spacing the first and second tracks parallel to each other.

26. The method of claim 25 comprising the further step of supporting at least one deck panel on the first and second tracks and on the deck channels.

27. A method of installing a track system on a building floor comprising the steps of:

a. providing first and second tracks extending in a longitudinal direction and generally parallel to each other;

b. securing a plurality of leveler channels transversely under each track;

c. providing a pair of leveling devices in each leveler channel; and d. fitting each of a plurality of deck channels over a selected one of the leveling devices of a first selected leveler channel secured to the first track, and fitting each of the deck channels over a selected one of the leveling devices of a second selected leveler channel secured to the second track and thereby transversely spacing the first and second tracks at accurate predetermined distances.

28. The method of claim 27 wherein the step of providing first and second tracks comprises the step of receiving first and second rails in the first and second tracks, respectively.

29. The method of claim 27 wherein the step of providing a pair of leveling devices comprises the steps of:

a. immovably holding a pair of insert nuts in each leveler channel;

b. engaging each insert nut with an elevator bolt;

c. resting the elevator bolts on the building floor; and d. turning the elevator bolts in the respective insert nuts and thereby adjusting the height of the track above the building floor.

30. The method of claim 29 wherein the step of fitting each of a plurality of deck channels comprises the steps of:

a. providing each of the plurality of elongated deck channels with first and second holes proximate first and second ends, respectively, thereof, b. fitting the first hole of each deck channel over a selected one of the insert nuts held in a selected leveler channel secured to the first track; and c. fitting the second hole of each deck channel over a selected one of the insert nuts held in a selected leveler channel secured to the second track and thereby transversely spacing the first and second tracks parallel to each other.

31. The method of claim 27 comprising the further step of supporting at least one deck panel on the first and second tracks and on the deck channels.

32. The method of claim 31 wherein:

a. the step of providing first and second tracks comprises the step of providing first and second tracks each with oppositely extending wings; and b. the step of supporting at least one deck panel comprises the step of supporting said at least one deck panel on the wings of the first and second tracks.

33. The method of claim 32 comprising the further step of joining said at least one deck panel to the wings of the first and second tracks and to the deck channels.

34. The method of claim 31 comprising the further steps of:

a. positioning at least one of said pair of leveling devices in operative association with each of said plurality of deck channels and in contact with the building floor; and b. adjusting said at least one of said pair of leveling devices to adjust the height of the associated deck channel above the building floor.

* * * * *